United States Patent [19]

Bacher

[11] Patent Number: 4,570,133

[45] Date of Patent: Feb. 11, 1986

[54] MICROWAVE ATTENUATOR

[76] Inventor: Helmut Bacher, 10952 Sweet Oak, Cupertino, Calif. 95014

[21] Appl. No.: 578,409

[22] Filed: Feb. 9, 1984

[51] Int. Cl.[4] ..... H01P 1/22

[52] U.S. Cl. ..... 333/81 A; 338/308

[58] Field of Search ..... 333/22 R, 81 R, 81 A; 338/216, 308, 309

[56] References Cited

U.S. PATENT DOCUMENTS

| | | | |
|---|---|---|---|
| 2,934,723 | 4/1960 | Hewitt, Jr. | 333/81 A |
| 3,157,846 | 11/1964 | Weinschel | 333/81 |
| 3,260,971 | 7/1966 | Bacher et al. | 333/81 |
| 3,464,037 | 8/1969 | Bramick et al. | 333/81 A |
| 3,621,567 | 11/1971 | Hasegawa et al. | 338/308 X |
| 3,824,506 | 7/1974 | Bacher | 333/81 |
| 4,309,677 | 1/1982 | Goldman | 333/81 |
| 4,310,812 | 1/1982 | DeBloois | 333/81 |

*Primary Examiner*—Paul Gensler

*Attorney, Agent, or Firm*—Townsend and Townsend

[57] ABSTRACT

According to the invention, a microstrip microwave frequency attenuator comprises a distributed series resistance medium and distributed shunt resistance medium, wherein the shunt resistance medium is disposed parallel to the direction established for electric fields in the microstrip between the signal path and ground through the energy supporting medium. In the preferred embodiment, the series resistance path has a resistance value per unit length equal to about one-third of the resistance value per unit length compared to the shunt resistance path between the series resistance path and the ground plane.

18 Claims, 7 Drawing Figures

MICROWAVE ATTENUATOR

BACKGROUND OF THE INVENTION

1. Field of the Invention

This invention relates to microwave frequency signal attenuators. In particular, it relates to a microwave frequency attenuator compatible with microstrip type circuit construction.

Desirable characteristics of microwave frequency attenuators are a high power handling capability and a flat frequency response over as wide a range of frequencies as is practical. Microwave frequency devices are very sensitive to structures which affect the field relations in the electrodes. As a consequence, attenuation characteristics may vary with frequency unless careful attention is given to the structural characteristics of devices intended for achieving the ideal attenuation characteristic.

The structure of high frequency circuits is particularly critical in integrated or near integrated (hybrid) circuit construction. Conventional integrated circuit construction is predisposed to design of circuits in a flat essentially single plane with minimal attention to field effects. Unfortunately, at microwave frequencies, the fields cannot be readily retained within the structurally desirable single plane along the path of propagation. As a consequence, parasitic fields may be generated in such structures which admit to signal interference and signal loss, as fields may interfere or otherwise attenuate a signal. What is therefore needed is a high frequency, i.e., microwave, signal attenuation device capable of flat frequency response from essentially zero frequency to a signal range where the wavelength is comparable to the size of the circuit, have high power handling capability and have a structure which is easily employed at essentially any attenuation level without any special design considerations.

2. Description of the Prior Art

U.S. Pat. No. 3,260,971 to the present inventor and E. R. Seitter issued July 12, 1966 describes a multilayered card attenuator for microwave frequencies which employed a distributed attenuator in a coaxial configuration. While suitable for coaxial configurations, the structure is unsuited to microstrip circuit applications.

U.S. Pat. No. 3,157,846 issued to B. O. Weinschel for a card attenuator for microwave frequencies describes another distributed coaxial microwave attenuator. The Weinschel patent describes a device which is essentially limited to single value resistive layers. This type of device has been found to exhibit disadvantages of poor flatness for attenuation of low value, e.g., in the 1 to 6 db range, and leakage problems at higher attenuation values (50 db to 100 db) especially at the higher frequencies, e.g., above 15 GHz.

U.S. Pat. No. 3,824,506 issued to the present inventor for microwave attenuators describes a still further coaxial distributed-resistance attenuator. In this patent, the distributed resistance is formed in the shape of a hollow tube or hemitube or hemicylinder in which the field lines are generally perpendicular to the resistive film.

U.S. Pat. No. 4,309,677 to Goldman describes a microstrip tee attenuator network in which attenuation elements are employed in a discrete structure. One of the embodiments described is a plated through circular hole. The Goldman patent teaches that the plated through hole minimizes undesired parasitic impedances normally encountered in prior art attenuator networks.

While Goldman recognizes the need to minimize undesired parasitic impedances, the structure fails to satisfactorily minimize those undesired parasitic impedances.

U.S. Pat. No. 4,310,812 issued to DeBloois for a high power attenuator and termination having a plurality of cascaded tee sections is illustrative of the single plane construction of prior art microstrip structures. The patent describes an attenuator having discrete shunt elements connected to a ground wrapped around the substrate so as to provide a connection in a single plane along the surface of the substrate. The electric fields are perpendicular to the shunt path giving rise to undesired parasitic impedances.

SUMMARY OF THE INVENTION

According to the invention, a microstrip microwave frequency attenuator comprises a distributed series resistance medium and distributed shunt resistance medium, wherein the shunt resistance medium is disposed parallel to the direction established for electric fields existing in the microstrip between the signal path and ground through the energy supporting medium. The structure essentially eliminates undesired parasitic impedances and closely approaches the ideal Heaviside relationships between resistance, conductance, inductance and capacitance such that attenuation is essentially frequency and structural shape independent. Thus, the attenuation of the structure is linearally proportional to length, independent of frequency, and has high power handling capabilities. The structure works equally well at low attenuation and at high attenuation. Attenuation characteristics can be tailored by changing the ratio of series resistance to shunt resistance. In the preferred embodiment for flat attenuation the series resistance path has a resistance value per unit length equal to about one-third of the resistance value per unit length compared to the shunt resistance path between the series resistance path and the ground plane.

DETAILED DESCRIPTION OF THE SPECIFIC EMBODIMENTS

Figure 1:
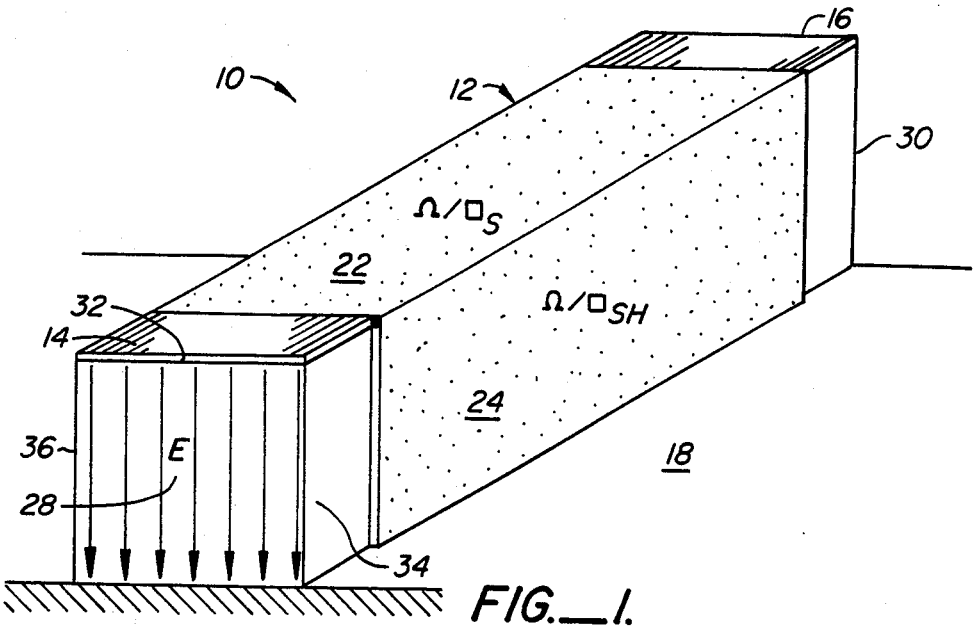
FIG. 1 is a perspective view of a microstrip attenuator.
Figure 2:
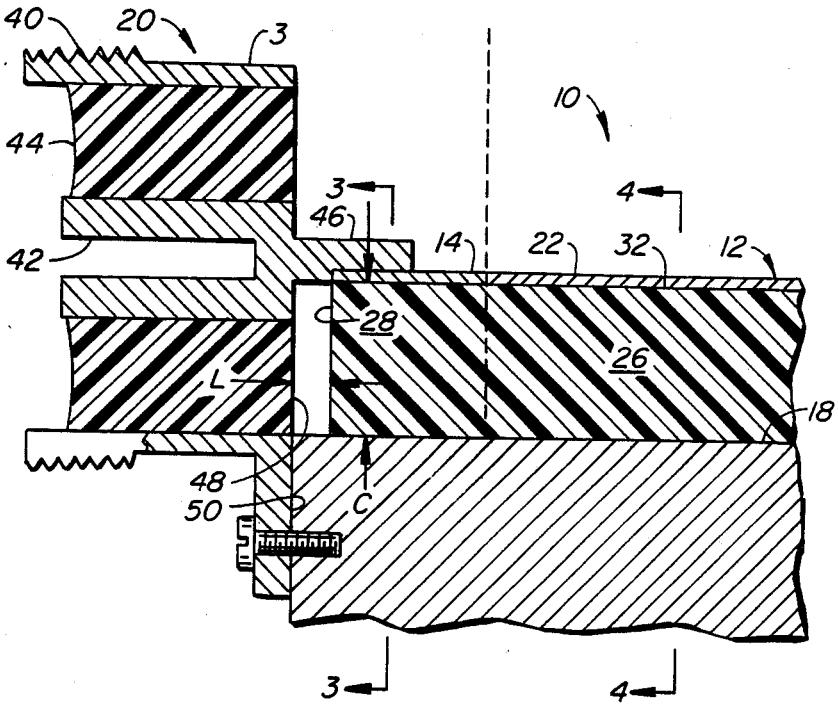
FIG. 2 is a cross-sectional view along the signal path of an attenuator showing a typical junction (transition) with a standard microwave coupling.
Figure 3:
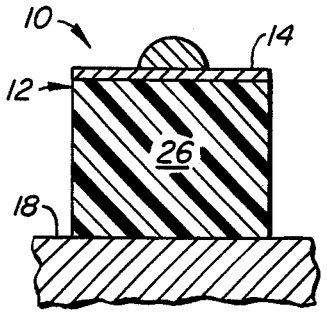
FIG. 3 is a cross-sectional view along a slice 3—3 of FIG. 2.
Figure 4:
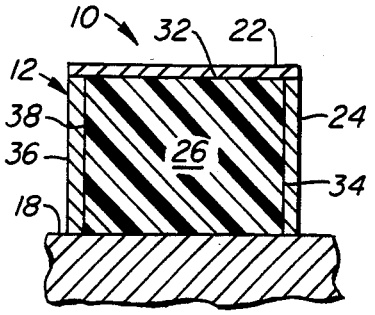
FIG. 4 is a cross-sectional view along a slice 4—4 of FIG. 2.

Referring to FIG. 1, there is shown a perspective view of a microstrip attenuator 10 according to the invention. The attenuator 10 comprises an energy supporting element 12, a first electrode 14, a second electrode 16 all mounted on a ground plane 18. Referring to FIG. 2, there is shown a cross-sectional view along a signal path of the attenuator 10 showing a typical junction with a standard microwave coupling 20. FIG. 3 is a cross-sectional view along section 3—3 of FIG. 2 and FIG. 4 is a cross-sectional along section line 4—4 of FIG. 2. Reference is made to FIGS. 1–4 together for the purpose of explaining the invention.

The energy supporting element comprises the first surface resistance element 22 and at least one second surface resistance element 24 laid upon flat margins of a dielectric medium 26. The dielectric medium 26 has a dielectric constant greater than 1.00 for sustaining an electric field in a TEM mode propagated between a first end 28 and a second end 30 of the attenuator 10. The surface first resistance element 22 is a carbon, thick film or metal material providing a resistive energy dissipated path between the first electrode 14 and the second electrode 16 along a flat margin 32, herein called the third margin. The third margin is parallel to the ground plane 18 and spaced generally parallel and uniformly from the ground plane 18.

The second surface resistive element 24 is laid upon a further margin, herein called first margin 34 of the dielectric medium 26 and terminating at or near the electrode 14. The second resistive element is a carbon, thick film or metal material providing a resistive electrical path between the first resistive element 22 and the ground plane 18. The resistance value in ohms per square of the first surface resistance element 22 generally differs from the resistance value of the second surface resistance element 24. According to the invention, the resistance value in ohms per square of the second surface resistance element 24 equals or exceeds the resistance value of the first resistance element 22 for attenuators with positive slope or flat frequency response. Where the resistance of the first surface resistance element 22 exceeds the resistance of the second surface resistance element 24, a negative slope frequency response attenuation will result.

Referring to FIG. 4, there is optionally a third surface resistance element 36 on the surface of the dielectric medium 26, specifically a second margin 38 extending between the ground plane 18 and the first margin 32. The second margin 38 may be parallel to the first margin 34, and the third margin 32 bridges the first margin 34 and the second margin 38. The third surface resistance element 36 may have a characteristic resistance value which differs from the other two elements 22 and 24. The margins 34 and 38 need not to be normal to the ground plane or parallel to each other in a suitable structure.

Figure 5:
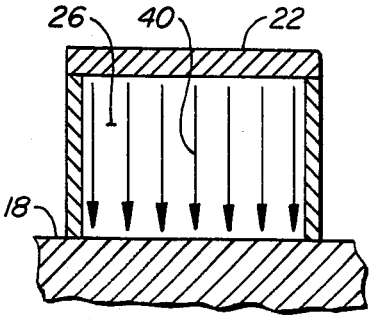
FIG. 5 illustrates the electric field paths in the attenuator according to the invention at any point along the signal path.

Referring to FIG. 5, there is shown a cross-sectional view of the attenuator 10 according to the invention illustrating the electric field path 40 at any point along the dielectric medium 26. Unlike other attenuators, the electric field path follows the shortest line between the first surface resistance element 22 and the ground plane 18 without fringing or potential loss of energy.

To achieve essentially a flat frequency response, it has been found that the ratio of surface resistivity values of the first surface resistance element 22 to the second surface resistance element 24 is between 1/6 and ½ and preferably about ⅓.

In FIG. 2, there is shown the coupling between the standard microwave coupling 20 and the electrode 14 in a standard microstrip to coax transition. The microwave coupling 20 comprises a coaxial combination of an outer conductor 40 and a center conductor 42 separated by a dielectric medium 44. The center conductor 42 is extended with a pin 46 from the end 48 of the coupling 20 to abut to the electrode 14. The characteristic impedance of the attenuator 10 must be matched to the characteristic impedance of the transmission line or termination represented by the coupling 20. To this end, matching may be effected by proper selection of the spacing between the end 48 and the end 28, controlling the inductance characteristic (L) and by proper selection of the spacing between the electrode 14 and the ground plane 18, thereby to control a parameter specifying the capacitance (C). Ideally, a 50 ohm resistive match is achieved, the outer conductor 40 being coupled to the ground plane 18 at an appropriate junction 50.

The inductance for a coaxial line can be calculated approximately from the following equation:

$$L=2Ln(D/d)$$

where

L is the inductance;

Ln is the natural logarithm;

D is the outer diameter of the coaxial coupling; and d is the inner diameter of the coaxial coupling. This value is expressed in nanohenrys per centimeter (nH/cm).

The computation of the capacitance is difficult because it involves the solution of a three dimensional LaPlace equation in steady state. Hence, matching is generally approximated and then optimized by use of a reflectometer measurement.

Figure 6:
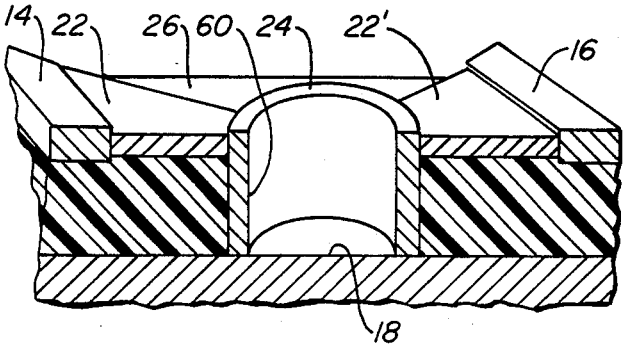
FIG. 6 is a perspective in partial cross-section of an attenuator wherein the shunt resistance is confined to a central hole through a microstrip and wherein the series resistance is confined to the space between the central hole and electrodes in a microstrip thereby to provide a non-distributed tee section attenuator.
Figure 7:
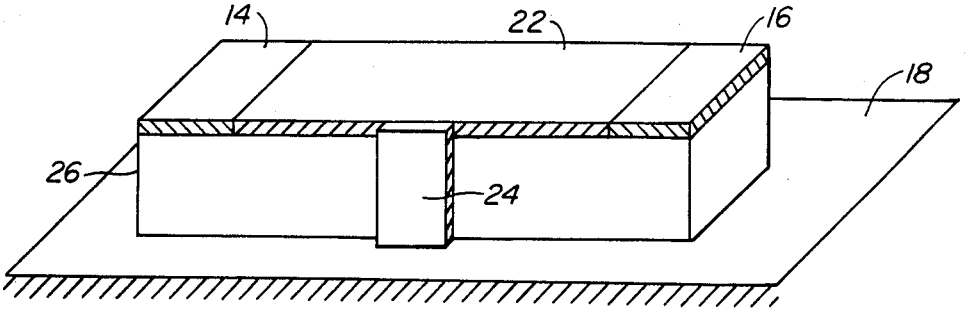
FIG. 7 is a perspective view of an alternative embodiment of a nondistributed resistance attenuator wherein the shunt resistance is confined to a region along the side of the dielectric between the series resistance and the ground plane.

Referring to FIG. 6, there is shown one embodiment of a T attenuator of a type which might be used where a T attenuator is required. Electrodes 14, 16 are coupled by first resistance elements 22 and 22' to a second resistance element 24 forming a shunt resistance confined to a cavity 60 through the dielectric material 26. The first resistance elements 22 and 22' are along the top margin opposing the ground plane 18, and the second resistance element 24 bridges the first resistance elements 22 and 22' and the ground plane 18, thereby forming a non-distributed element T section attenuator. The first resistance elements are typically tapered from the electrodes to the annulus around the cavity 60 formed by the second resistance element 24 in order to maintain a reasonably uniform electric field density in the dielectric 26. Other configurations for attenuators are also within the scope of the invention without departing therefrom. In FIG. 7, there is a perspective view of a non-distributed resistance attenuator wherein the shunt resistance element 24 is confined to a region along the side of the dielectric 26 between the series surface resistance element 22 and the ground plane 18. The series surface resistance element 22 extends between electrodes 14 and 16. The breadth of the shunt resistance element 24 along the edge of the series resistance element 22 is readily selected for the appropriate resistance value and likewise can be trimmed to match custom characteristics.

An attenuator in accordance with the invention is compatible with existing microwave microstrip circuit design techniques and is capable of achieving a flat or tailored frequency response independent of structural shape. An attenuator according to the invention has high power handling capability especially if the substrate is highly heat conductive.

The invention has now been explained with reference to specific embodiments. Other embodiments will be apparent to those of ordinary skill in this art. It is therefore not intended that this invention be limited except as indicated by the appended claims.

I claim:

1. A microstrip attenuator for operation up to microwave frequencies comprising:

an energy supporting element, said energy supporting element comprising a first surface resistance element, a second surface resistance element and a medium having a dielectric constant greater than one for sustaining an electric field in a TEM mode, said energy supporting element having a first end and a second end, a first flat margin, a second flat margin, a third flat margin and a fourth flat margin thereby to form a structure having at least six external sides, said fourth margin abutting a ground plane, said ground plane being flat with respect to said energy supporting element, said first margin being spaced from and opposing said second margin, said third margin being disposed parallel to said ground plane and bridging between said first margin and said second margin, said second surface resistance element being laid upon said second margin and extending between said first end and said second end, said first surface resistance element being laid upon said third margin and being perpendicular to electric field lines between said third margin and said fourth margin;

means for coupling energy to said first end; and means for coupling energy from said second end.

2. The attenuator according to claim 1 wherein said first surface resistance element is a film and wherein said second surface resistance element is a film.

3. The attenuator according to claim 1 wherein the ratio of resistivity values between said first surface resistance element and second surface resistance element is selected to conform to a predefined attenuation characteristic which is dependent on frequency of operation.

4. The attenuator according to claim 2 wherein said first surface resistance element has a resistivity per square value equal to between about one-six and one-half of the resistivity per square value of the second surface resistance element.

5. The attenuator according to claim 2 wherein said first surface resistance element has a resistivity per square value equal to about one-third of the resistivity per square of the second surface resistance element.

6. A microstrip attenuator for operation up to microwave frequencies comprising:

an energy supporting element, said energy supporting element comprising a first surface resistance element, a second surface resistance element and a medium having a dielectric constant greater than one for sustaining an electric field in a TEM mode, said energy supporting element having a first end and a second end, a first flat margin, a second flat margin, a third flat margin and a fourth flat margin, said fourth margin abutting a ground plane, said first margin being spaced from and opposing said second margin, said third margin being disposed parallel to said ground plane and bridging between said first margin and said second margin, said second surface resistance element being laid upon said second margin and extending between said first end and said second end, said first resistance element being laid upon said third margin and being perpendicular to electric field lines between said third margin and said fourth margin and further including a third surface resistance element disposed between said first margin;

means for coupling energy to said first end; and means for coupling energy to said second end.

7. The attenuator according to claim 2 wherein the ratio of resistivity values between said first surface resistance element and said second surface resistance element is selected to conform to a predefined attenuation characteristic which is dependent on frequency of operation.

8. The attenuator according to claim 7 wherein said first surface resistance element has a resistivity per square value equal to between about one-sixth and one-half of the resistivity value per square of the second resistance element.

9. The attenuator according to claim 7 wherein said first surface resistance element has a resistivity per square value equal to about one-third of the resistivity per square of the second surface resistance element.

10. The attenuator according to claim 9 further including a third surface resistive element disposed between said third margin and said fourth margin and laid upon said first margin and parallel to said second margin.

11. A microstrip attenuator for operation at microwave frequencies comprising an energy supporting element, said energy supporting element comprising a first resistance element, a second resistance element and a medium with a dielectric constant greater than unity for supporting an electric field in a TEM mode, said energy supporting element having a first end and a second end, a first flat margin, a second margin, a third flat margin and a fourth flat margin, said third margin being spaced from, opposed and parallel to said fourth margin, and said third margin being disposed to bridge between said first margin and said second margin, said fourth margin being in contact with a ground plane between said first end and said second end, said ground plane being flat with respect to said energy supporting element, said first resistance element being laid upon said third margin between said first end and said second end, said second resistance element being laid upon said second margin so as to bridge between said third margin and said fourth margin and so as to be parallel to electric field lines between said first margin and said second margin;

means for coupling energy into said first end; and means for coupling energy from said second end.

12. The attenuator according to claim 11 wherein said said second margin is formed by walls of a cavity through said energy supporting element between said third margin and said fourth margin.

13. The attenuator of claim 11 wherein said first resistance element comprises a first part and a second part, said first part being coupled to said first end and to said second resistance element, and said second part being coupled to said second end and to said second resistance element.

14. The attenuator according to claim 11 wherein said first surface resistance element is a film and wherein said second surface resistance element is a film.

15. The attenuator according to claim 12 wherein said first surface resistance element has a resistivity per square value equal to about one-third of the resistivity per square of the second resistance element.

16. The attenuator according to claim 14 wherein said first surface resistance element has a resistivity per square value equal to about one-third of the resistivity value per square of the second resistance element.

17. The attenuator according to claim 14 further including a third surface resistive element disposed between said third margin and said fourth margin and laid upon said first margin.

18. The attenuator according to claim 16 further including a third resistive element disposed between said third margin and said fourth margin and laid upon said first margin.

* * * * *